United States Patent [19]

Grande

[11] Patent Number: 4,795,155

[45] Date of Patent: Jan. 3, 1989

[54] POWDER DOWN DOOR OPEN MEMORY LATCH FOR A GAMING DEVICE

[76] Inventor: Fulvio R. Grande, 2249 N. Kedvale, Chicago, Ill. 60639

[21] Appl. No.: 880,125

[22] Filed: Jun. 30, 1986

[51] Int. Cl.[4] ..... A63F 5/04

[52] U.S. Cl. ..... 273/143 R; 273/138 A

[58] Field of Search ..... 273/1 E, 138 A, 143 R, 273/85 G; 340/825.55

[56] References Cited

U.S. PATENT DOCUMENTS 4,231,105 10/1980 Schuller et al. ..... 364/900

4,366,481 12/1982 Main et al. ..... 340/825.55

4,607,844 8/1986 Fullerton ..... 273/138 A

*Primary Examiner*—Maryann Lastova

[57] ABSTRACT

A powder down door open memory latch circuit for a gaming device which determines whether a door on the gaming device has been opened during a power failure. The circuit includes a cam switch coupled to a lock on the door of the gaming device, the switch being actuated to provide a signal when the door is unlocked. The circuit also includes a hinge switch mounted adjacent a hinge connecting the door to the cabinet of the gaming device to provide a signal when the door is opened. Each of the switch signals is coupled to a respective battery powered memory latch to cause the latches to change from a cleared state to a second state when the door is unlocked and open. Upon the restoration of power after a powder failure, the main processor for the gaming device determines the states of the latches and if the memory latch states indicate that the door was unlocked and opened during a power failure, the processor tilts the gaming device to prevent further operation thereof.

7 Claims, 2 Drawing Sheets

POWDER DOWN DOOR OPEN MEMORY LATCH FOR A GAMING DEVICE

TECHNICAL FIELD

The present invention relates to a door open memory latch circuit for a gaming device and more particularly to such a circuit which is operable during a power failure for detecting whether a door on the gaming device is open or not and for providing stored information indicative thereof, the information being read by the main processor of the gaming device upon the restoration of power.

BACKGROUND OF THE INVENTION

Access to the controls for known gaming devices may typically be attained through a locked door on the device. In order to provide an indication that the door is open and to prevent tampering with the controls, known gaming devices have employed one or more switches mounted on the door to detect whether the door is open, the switches being coupled to a light or the like to provide a door open indication. Although these switches may be adequate when power to the gaming device is on, if power is lost, a player may open the door, tamper with the controls to obtain a win on the next play and close the door without there being any indication or record that the door had been opened during the power failure.

SUMMARY OF THE INVENTION

In accordance with the present invention, the disadvantages of prior door open detection systems for gaming devices, as discussed above, have been overcome. The system of the present invention is operable during a power failure to detect whether a door on the gaming device is open and if it is, the system stores a signal in a latch indicative thereof. Upon the restoration of power, a game control processor reads the contents of the latch to determine whether the door was opened during the power failure and if so, the processor tilts the gaming device to prevent further operation.

More specifically, the gaming device of the present invention includes two switches for reliability each switch being coupled to the door on the gaming device through which access to the game controls may be had. Each of the switches is operable during a power failure for detecting whether the door is open to provide a signal indicative thereof. Each of the switches is coupled through a debounce circuit to a respective memory latch having first and second states. Each memory latch is operable during a power failure to be responsive to a door open signal from its respective switch to change from a first state to a second state indicating that the door has been opened. The main game control processor of the gaming device determines the state of each of the memory latches upon the restoration of power and if the states of the latches indicate that the door was opened during the power failure, the processor tilts the gaming device to prevent further operation thereof.

These and other objects and advantages of the invention, as well as details of an illustrative embodiment, will be more fully understood from the following description and the drawings.

BEST MODE FOR CARRYING OUT THE INVENTION

Figure 1:
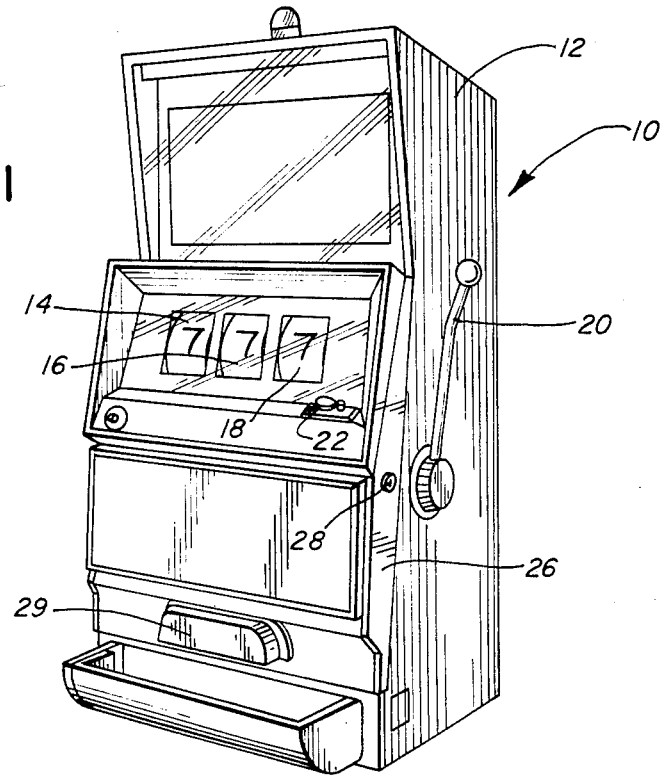
FIG. 1 is a perspective view of a gaming device employing the power down door open memory latch circuit of the present invention.
Figure 5:
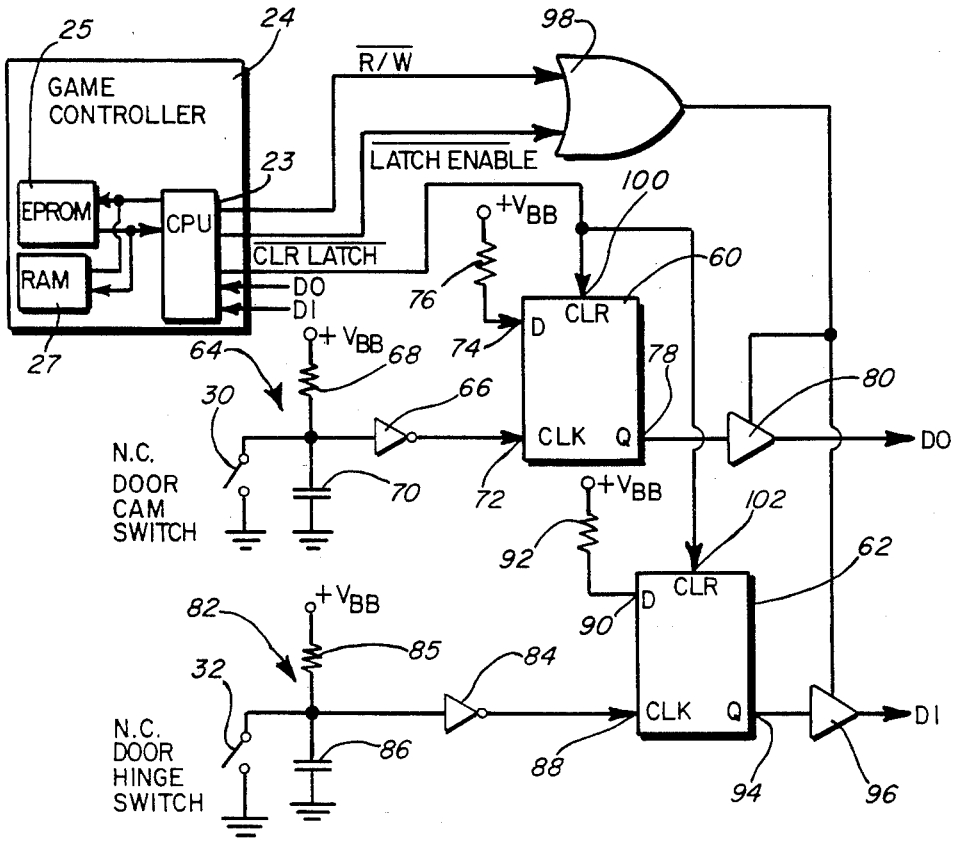
FIG. 5 is a schematic diagram of the power down door open memory latch circuit of the present invention.

A gaming device 10 which employs the power down door open memory latch circuit of the present invention is shown in FIG. 1. The gaming device 10 includes three symbol bearing reels 14, 16 and 18 which are controlled to rotate in response to the pulling of a handle 2 after a coin is inserted into a coin input slot 22. The gaming device 10 also includes a game controller, 24, as shown in FIG. 5, having a processor 23 coupled to an EPROM 25 and RAM 27 which respectively store software and data for controlling the operation of the game. The game controller 24 stops the rotating reels 14, 16 and 18 after a period of time to display randomly selected symbols along a win line. If the symbols displayed along the win line form a winning combination, the game controller 24 causes a coin hopper to payout, through a payout chute 29, a number of coins or tokens.

Figure 2:
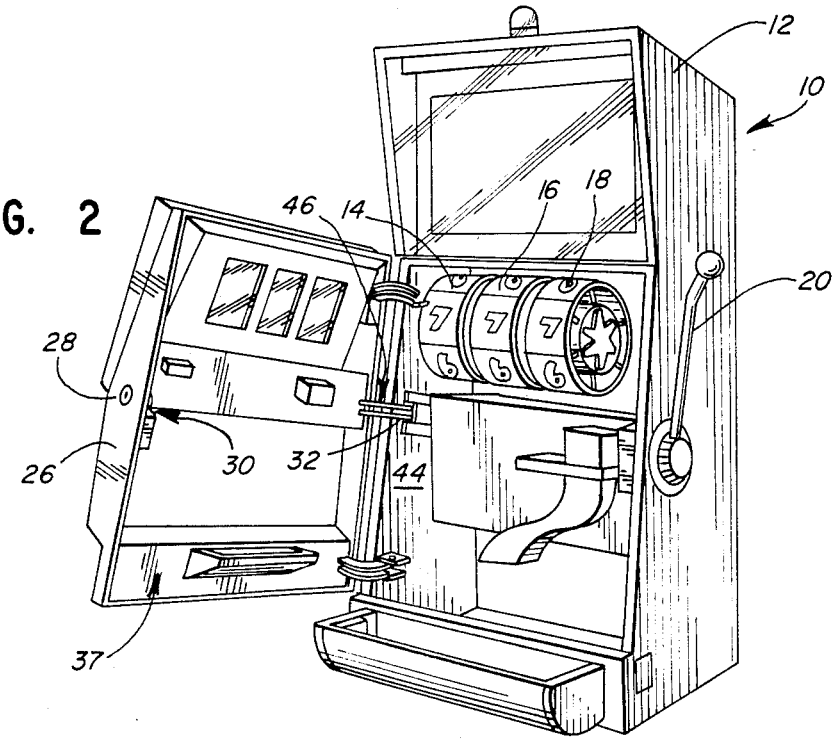
FIG. 2 is a perspective view of the gaming device shown in FIG. 1 with an open door.
Figure 3:
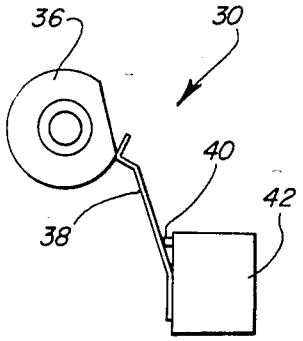
FIG. 3 is an enlarged view of a cam switch shown in FIG. 2.
Figure 4:
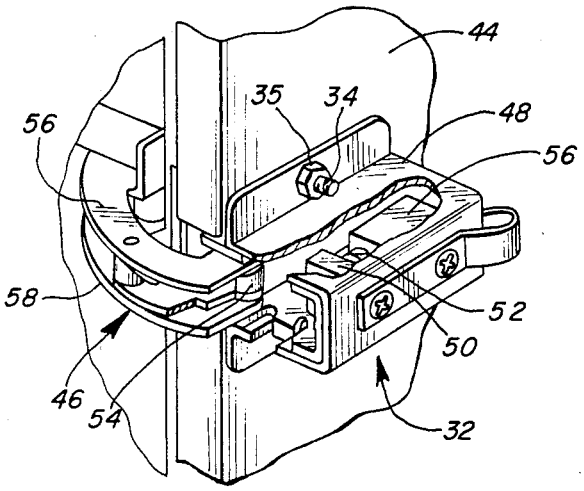
FIG. 4 is an enlarged view of a hinge switch shown in FIG. 2.

Access to the controls for the gaming device 10 may be attained through a door 26 which is normally maintained closed by a lock 28. As shown in FIGS. 2–4, the gaming device 10 includes a cam switch 30 and a hinge switch 32 each of which is responsive to the opening of the door 26 to provide a signal indicative thereof. Either one or both of the switches 30 or 32 may be coupled to a light 33 located on the top of the cabinet 12, the switches actuating the light when the door 26 is open. More importantly however, each of the switches 30 and 32 is coupled to a respective memory latch which is operable during a power failure to store a signal from its respective switch indicating whether the door was opened during the power failure as discussed in detail below with reference to FIG. 5.

As shown in FIG. 3, the cam switch 30 includes a cam 36 mounted for rotation adjacent to the lock 28 on the backside 37 of the door 26 so as to be rotated in a counterclockwise direction as the lock 28 is unlocked to open the door. As the cam 36 rotates in a counterclockwise direction, the cam causes a leaf spring 38 to actuate a spring biased contact 40 to open a normally closed switch contained within a switch housing 42. When the normally closed switch contained in the housing 42 is opened, a door open signal is provided to a memory latch as discussed below.

As shown in FIG. 4, a housing 48 for the hinge switch 32 is secured, by means of a nut 35 and bolt 34, to an inner sidewall 44 of the cabinet 12, adjacent the center hinge 46 of the door 26. The hinge switch 32 contains, within the housing 48 an actuator 50 which is outwardly biased by a spring 52. When the door 26 is closed, a roller 54 mounted between two plates 56 and 58 of the hinge 46 contacts the actuator 50, compressing the spring 52 so that a switch coupled to the actuator 50 and contained within a housing 56 is closed. When the door 26 is opened, the normally closed switch contained with the housing 56 opens to provide a door open signal as discussed below.

As shown in FIG. 5, each of the switches 30 and 32 is coupled to a respective memory latch 60 and 62 to store information indicating whether the door 26 of the gaming device was opened during a power failure or not. Upon the restoration of power, the game controller 24 reads each of the latches 60 and 62 and if it is determined that the door 26 was opened, the controller 24 tilts the gaming device to prevent further operation thereof.

More particularly, the cam switch 30, represented schematically in FIG. 5 as a normally closed switch, is coupled to the memory latch 60 through a debounce circuit 64 and an inverter 66. The debounce circuit 64 which includes a 4.7 kω resistor 68 and a series connected 0.O1 μf capacitor 70 coupled between a battery voltage $+V_{BB}$ and ground, filters a negative going signal applied to the input of the inverter 66 when the switch 30 is opened by the unlocking and opening of the door 26. When the door 26 is open, the negative going signal applied to the input of the inverter 66 produces a high input applied to a clocking input terminal 72 of the memory latch 60. The memory latch 60 is a flip-flop the D input terminal 74 of which is coupled to the battery voltage $+V_{BB}$ through a 4.7 kω resistor 76 so that the latch 60 is operable during a power failure. In its cleared state, the Q output terminal 78 of the flip-flop memory latch 60 is low. However, in response to a high signal applied to the clocking input terminal 72 of the latch, indicating that the door 26 is open, the flip-flop 60 changes to a second state in which the high signal at the input of the D terminal 74 is clocked to the Q output terminal 78 to provide a high output signal to a tri-state buffer 80.

Similarly, the hinge switch 32, represented schematically in FIG. 5 as a normally closed switch, is coupled to the memory latch 62 through a debounce circuit 82 and an inverter 84. The debounce circuit 82 which includes a 4.7kω resistor 85 and a series connected 0.O1 μf capacitor 86 coupled between the battery voltage $+V_{BB}$ and ground, filters a negative going signal applied to the input of the inverter 84 when the switch 32 is opened indicating that the door 26 is open. When the door 26 is open, the inverter 84 is responsive to the negative going signal applied to its input to provide a high signal to the clocking input terminal 88 of the memory latch 62. The memory latch 62 is a flip-flop whose D input terminal 90 is coupled to the battery voltage $+V_{BB}$ through a 4.7 kω resistor 92 so that the flip-flop is operable during a power failure. In the flip-flop's cleared state, the Q output terminal 94 of the flip-flop is low. However, in response to a high input signal applied to the clocking input terminal 88 of the flip-flop indicating the door 26 is open, the high signal applied to the D input terminal 90 of the flip-flop is clocked to the Q output terminal 94 to provide a high signal to a tri-state buffer 96.

Each of the tri-state buffers 80 and 96 is coupled to the output of an OR gate 98, the inputs of which are a R/W signal and a LATCH ENABLE signal from the game controller processor 23. Upon the restoration of power to the gaming device 10 after a power failure has occurred, the processor 23 reads the memory latches 60 and 62 by enabling the tri-state buffers 80 and 96 through the OR gate 98 to cause the buffer to couple signal D0 and D1 to the processor 23. The signals D0 and D1 indicate the states of the respective memory latches 60 and 62 such that high D0 and D1 signals indicate that the respective door switches 30 or 32 were opened during the power failure. The controller 23 responds to the D0, D1 signals indicating that the door 26 was opened during the power failure to tilt the gaming device 10 to prevent further operation thereof. Thereafter the processor 23 clears each of the latches 60 and 62 by means of a clear latch signal CLR LATCH applied to respective clear terminals 100 and 102 of the flip-flops 60 and 62.

Although only one door open switch 30 or 32 coupled to a memory latch 60 or 62 is required for the power down door open memory scheme of the present invention, in the preferred embodiment, both switches are employed for reliability. More particularly, it is possible that the cam switch 30 could be opened by someone jiggling the lock 28 without the door 26 actually being opened. In this case, the opening of switch 30 would cause a high output at the Q terminal 78 of the flip-flop 60 but the switch 32 which would remain closed with the door 26 so that the flip-flop 62 would remain in its cleared state. In response to a high D0 signal and a low D1 signal, the processor 23 might not necessarily tilt the gaming device 10.

I claim:

1. In a gaming device having a cabinet housing controls for the gaming device, the cabinet having a door through which access to the controls may be had, a system for detecting whether the door has been opened during a power failure comprising:

switch means secured to said door and operable during a power failure for sensing whether said door is open or closed to provide a signal indicative thereof;

memory means operable during a power failure and responsive to a door open signal from said switch means for storing information indicating that said door has been opened; and game control means for reading the information stored in said memory means upon the restoration of power after a power failure to determine whether said door was opened during the power failure.

2. The gaming device of claim 1 wherein said game control means is responsive to information read from the memory means indicating that said door was opened during the power failure to halt the operation of said gaming device.

3. The gaming device of claim 1 wherein said memory means has a first, cleared state and a second state, indicating that the door has been opened, and wherein said memory means is responsive to a door open signal to change from said first state to said second state; and said game control means provides a memory control signal to the memory means to cause said memory means to return to said first state after said control means has read the information stored therein.

4. In a gaming device having a cabinet housing controls for the gaming device, said cabinet having a door with a lock, access to said controls being had when said door is unlocked, a system for detecting whether said door has been opened during a power failure comprising:

a first switch means coupled between said door and said cabinet and operable during a power failure for sensing whether the door is open or closed to provide a signal indicative thereof;

second switch means coupled to said door lock and operable during a power failure for sensing whether the door is locked or unlocked to provide a signal indicative thereof;

first memory means operable during a power failure and responsive to a door open signal from said first switch means for storing information indicating that said door has been opened;

second memory means operable during a power failure and responsive to a door unlock signal from said second switch means for storing information indicating that said door has been unlocked;

signal means for generating a restoration signal when power has been restored to the gaming device after a power failure; and control means responsive to said restoration signal for reading the information stored in said first and second memory means, said control means halting the operation of said gaming device if the read information indicates that the door has been unlocked and opened.

5. In a gaming device having a cabinet housing controls for the gaming device, the cabinet having a door through which access to the controls may be had, a system for detecting whether the door has been opened during a power failure, comprising:

switch means secured to said door and operable during a power failure for sensing whether said door is open or closed to provide a signal indicative thereof;

memory latch means having a cleared state and a door open state, said memory latch means being operable during a power failure and responsive to a door open signal coupled thereto from the switch means for changing from said first state to said second state to indicate that the door has been opened; and game control means for determining the state of said memory latch means upon the restoration of power after a power failure to halt the operation of the gaming device if the state of the memory latch means indicates that the door has been opened.

6. The gaming device of claim 5 wherein said memory latch means includes a flip-flop powered during a power failure by a battery.

7. In a gaming device having a cabinet housing controls for the gaming device, the cabinet having a door with a lock, access to said controls being had when said door is unlocked, a system for detecting whether said door has been opened during a power failure comprising:

first switch means coupled between said door and said cabinet and operable during a power failure for sensing whether the cabinet is open or closed to provide a signal indicative thereof;

second switch means coupled to said door lock and operable during a power failure for sensing whether the door is locked or unlocked to provide a signal indicative thereof;

first memory latch means having a cleared state and a door open state, said first memory latch means being operable during a power failure and responsive to a door open signal coupled thereto from the first switch means for changing from said first state to said second state to indicate that the door has been opened;

second memory latch means having a cleared state and a door unlock state, said second memory latch means being operable during a power failure and responsive to a door unlock signal coupled thereto from the second switch means for changing from said first state to said second state to indicate that the door has been unlocked; and game control means for determining the state of the first memory latch means and the second memory latch means upon the restoration of power after a power failure to halt the operation of the gaming device if the states of the first and second memory latch means indicate that the door has been unlocked and opened.

* * * * *

UNITED STATES PATENT AND TRADEMARK OFFICE

CERTIFICATE OF CORRECTION

PATENT NO. : 4,795,155

DATED : January 3, 1989

INVENTOR(S) : Fulvio R. Grande

It is certified that error appears in the above-identified patent and that said Letters Patent is hereby corrected as shown below:

On the title page, item [54], and in column 1, line 1:
In the title of the patent change "POWDER" to -- POWER --

In the Abstract, lines 1 and 14, change "powder" to -- power --

Column 1, line 1, change "POWDER" to -- POWER --

Column 1, line 47, after "reliability" insert a comma -- , --

Column 2, line 23, change "2" to -- 20 --

Column 3, lines 18, 28, 42 and 52, change "k$\omega$" to -- k$\Omega$--

Column 3, line 63, change "R/W" to -- $\overline{R/W}$ --

Column 3, line 63, change "LATCH ENABLE" to -- $\overline{\text{LATCH ENABLE}}$ --

Column 4, line 10, change "CLR LATCH" to -- $\overline{\text{CLR LATCH}}$ --

Signed and Sealed this

Sixth Day of April, 1993

*Attest:*

STEPHEN G. KUNIN

*Attesting Officer*

*Acting Commissioner of Patents and Trademarks*